US011377714B2

(12) United States Patent
Kudo et al.

(10) Patent No.: US 11,377,714 B2
(45) Date of Patent: Jul. 5, 2022

(54) METHOD FOR PRODUCING TI-AL ALLOY

(71) Applicant: KOBE STEEL, LTD., Kobe (JP)

(72) Inventors: Fumiaki Kudo, Hyogo (JP); Daisuke Matsuwaka, Hyogo (JP); Hitoshi Ishida, Hyogo (JP); Tetsushi Deura, Hyogo (JP)

(73) Assignee: KOBE STEEL, LTD., Kobe (JP)

( * ) Notice: Subject to any disclaimer, the term of this patent is extended or adjusted under 35 U.S.C. 154(b) by 294 days.

(21) Appl. No.: 16/487,182

(22) PCT Filed: Feb. 23, 2018

(86) PCT No.: PCT/JP2018/006823

§ 371 (c)(1),
(2) Date: Aug. 20, 2019

(87) PCT Pub. No.: WO2018/155658

PCT Pub. Date: Aug. 30, 2018

(65) Prior Publication Data

US 2020/0377972 A1 Dec. 3, 2020

(30) Foreign Application Priority Data

Feb. 23, 2017 (JP) ..... JP2017-032273
Apr. 13, 2017 (JP) ..... JP2017-079928
Oct. 11, 2017 (JP) ..... JP2017-197905

(51) Int. Cl.
*C22C 1/03* (2006.01)
*B22D 11/059* (2006.01)
(Continued)

(52) U.S. Cl.
CPC ..... *C22C 1/03* (2013.01); *B22D 11/059* (2013.01); *B22D 11/108* (2013.01); *B22D 21/04* (2013.01); *C22C 14/00* (2013.01); *C22C 21/00* (2013.01)

(58) Field of Classification Search
None
See application file for complete search history.

(56) References Cited

U.S. PATENT DOCUMENTS 3,234,608 A 2/1966 Peras
2016/0376685 A1* 12/2016 Banik ..... C22B 9/003 75/10.15
2017/0283906 A1 10/2017 Kudo et al.

FOREIGN PATENT DOCUMENTS

JP 53-86603 A 7/1978
JP 11-246919 A 9/1999
(Continued)

OTHER PUBLICATIONS

Extended European Search Report dated Jul. 3, 2020 in Patent Application No. 18756604.7, citing document AA therein, 11 pages.
(Continued)

*Primary Examiner* — Brian D Walck
(74) *Attorney, Agent, or Firm* — Oblon, McClelland, Maier & Neustadt, L.L.P.

(57) ABSTRACT

A method includes the production of a primary ingot, the production of a secondary ingot, and the removal of a flux layer. A CaO—$CaF_2$ flux in a content of 3-20 mass % and obtained by mixing 35-95 mass % of $CaF_2$ with CaO is added to a Ti—Al alloy material including a total of at least 0.1 mass % of oxygen and at least 40 mass % of Al, and the resultant substance is melted by a melting method using a water-cooled copper container in an atmosphere having a pressure of 1.33 Pa or higher and held to produce the primary ingot. The primary ingot is continuously drawn downwards while being melted by a melting method using a bottomless water-cooled copper casting mould in an atmosphere having a pressure of 1.33 Pa or higher to produce the
(Continued)

secondary ingot. The flux layer deposited on the surface of the secondary ingot is mechanically removed.

4 Claims, 3 Drawing Sheets

(51) Int. Cl.

| | |
|---|---|
| ***B22D 11/108*** | (2006.01) |
| ***B22D 21/04*** | (2006.01) |
| ***C22C 14/00*** | (2006.01) |
| ***C22C 21/00*** | (2006.01) |

(56) References Cited

FOREIGN PATENT DOCUMENTS

| | | | |
|---|---|---|---|
| JP | 2006-122920 | A | 5/2006 |
| JP | 2013-49084 | A | 3/2013 |
| WO | WO 2016/035824 | A1 | 3/2016 |

OTHER PUBLICATIONS

International Search Report and Written Opinion dated May 1, 2018 in PCT/JP2018/006823, citing documents AA and AO-AQ therein, 16 pages (with English translation).

* cited by examiner

Example 1 A cross-section SEM image of a second ingot before mechanical removal
CaO-$CaF_2$ flux (containing $Al_2O_3$) is discharged on the surface of the second ingot.

METHOD FOR PRODUCING TI-AL ALLOY

TECHNICAL FIELD

The present invention relates to a method for producing a Ti—Al alloy, in which an aluminum raw material and a flux are added to a low-grade titanium raw material such as lower sponge titanium, scrap titanium or titanium oxide ($TiO_2$) represented by rutile ore so as to produce a high-grade, that is, low-oxygen Ti—Al alloy.

BACKGROUND ART

In recent years, demand for a Ti—Al alloy as a raw material for airplanes and automobiles is growing. The Ti—Al alloy is very active to oxygen. Accordingly, in the background art, the Ti—Al alloy is melted and cast by use of a method capable of reducing the influence of oxygen, such as a vacuum arc remelting method (VAR), an electron beam melting method (EB), a plasma arc melting method (PAM), a vacuum induction melting (VIM) and a cold crucible induction melting (CCIM).

Among those melting methods, in the melting method such as VAR, EB or VIM, a melting process is performed under a vacuum atmosphere. Accordingly, not only Al but also Ti as an alloy element are evaporated during the melting process. Thus, it is difficult to control the composition of the melted Ti—Al alloy in the industrial process, and there is a fear that an increase in the production cost is incurred.

As for a titanium raw material used for producing a Ti—Al alloy, a high-grade titanium raw material with a low oxygen content is typically used. However, the price of the high-grade titanium raw material tends to rise in recent years. A need to produce a high-grade, that is, low-oxygen Ti—Al alloy in spite of use of a low-grade titanium raw material having a high oxygen content, such as ore or scrap.

Accordingly, there has been proposed a technique for producing a Ti—Al alloy not by use of a melting method such as VAR, EB or VIM easily causing a loss of Ti due to volatilization, but by use of a melting method such as PAM or CCIM. In such a technique, a Ti—Al alloy is produced from a low-grade raw material (a titanium raw material with a high oxygen content of 0.1 mass % or more) by deoxidization while reducing an Al or Ti volatilization loss.

For example, Patent Literature 1 gives suggestion as follows. When 40 mass % or more of Al is added to Ti with a high oxygen content, melted and retained under an atmosphere of 1.33 Pa or more by use of PAM or CCIM, oxygen in a Ti—Al alloy is coupled with Al and discharged from the Ti—Al in a form of $Al_2O_3$, thereby advancing deoxidization. In addition, when a CaO—$CaF_2$ flux is added, the activity of $Al_2O_3$ is reduced to further advance the deoxidization.

In the aforementioned production method of Patent Literature 1, oxygen in the Ti—Al alloy is indeed discharged in the form of $Al_2O_3$ so that the Ti—Al alloy can be deoxidized. However, when the Ti—Al alloy is melted and retained simply by use of PAM or CCIM, the $Al_2O_3$ as a byproduct of the deoxidization or the CaO—$CaF_2$ flux added for accelerating the deoxidization may remain in a specific part of the Ti—Al alloy. Thus, a part where deoxidization has been advanced and a part where deoxidization has not been advanced (the part where the $Al_2O_3$ remains) may be mixed in the Ti—Al alloy.

In addition, Patent Literature 1 suggests that when low-oxygen Ti, that is, high-grade Ti such as pure Ti is added to the Ti—Al alloy in which the $Al_2O_3$ or the CaO—$CaF_2$ flux remains partially. Al can be diluted, so as to produce a Ti—Al alloy having an Al content lower than 40 mass % and having a low oxygen content.

However, due to the part where the $Al_2O_3$ or the CaO—$CaF_2$ flux remains in the Ti—Al alloy, the $A_2O_3$ or the like inside the flux is decomposed/remelted to increase the oxygen density or the like contrarily when the pure Ti is added to the Ti—Al alloy to produce a Ti—Al alloy having an Al content lower than 40 mass %. Therefore, according to the production method of Patent Literature 1, it is not easy to obtain a high-grade, that is, low-oxygen Ti—Al alloy having an Al content lower than 40 mass %.

When the part where the $A_2O_3$ or the like remains is removed mechanically by cutting or the like and high-grade, that is, low-oxygen Ti is then added, a Ti—Al alloy having an Al content lower than 40 mass % can be obtained. However, a part of metal Ti is removed together when the $Al_2O_3$ or the like is removed mechanically. Therefore, the yield of the Ti—Al alloy deteriorates extremely, causing increase in cost.

That is, in the deoxidization method of Patent Literature 1, it is important how to prevent the $Al_2O_3$ or the CaO—$CaF_2$ flux from remaining in the Ti—Al alloy having an Al content of 40 mass % or more. To say other words, when the $A_2O_3$ or the CaO—$CaF_2$ flux remains, it is important how to separate/remove substances such as the residual flux from the Ti—Al alloy.

With respect to this point, Patent Literatures 2 to 5 disclose techniques useful for separating/removing substances such as a residual flux from a Ti—Al alloy.

For example, Patent Literature 2 suggests that when active metal is continuously melted and solidified using a plasma arc as a heat source to thereby cast an ingot, a flux such as $CaF_2$ is heated and melted in advance and the active metal is then fed thereinto, or the flux is fed together with the active metal, so that the flux is incorporated between a water-cooled copper crucible and the ingot to thereby slowly and gradually cool and solidify the surface of the ingot so as to produce an ingot having a smooth ingot surface.

In addition, Patent Literature 3 suggests that when titanium or a titanium alloy is continuously melted and solidified using a plasma arc as a heat source and using a water-cooled copper mold having a rectangular shape in section to thereby cast an ingot, a flux such as $CaF_2$ is fed with an added amount changed depending on a mold position so that an effect of gradually cooling an interface between the water-cooled copper mold and the molten metal can be produced to cast a slab excellent in its casting surface state.

Patent Literature 4 describes a method for refining a molten metal in which when Ti added with a rare earth metal (cerium or mischmetal in examples) as a deoxidizer and calcium fluoride ($CaF_2$) as a flux is melted by use of a cold crucible levitation melting apparatus (CCIM), the molten flux can be incorporated between the molten metal and a water-cooled copper crucible, and solid or liquid non-metal inclusions are shifted into the layer of the molten flux, thereby improving the cleanliness of the molten metal.

Typically, it is known that when a metal containing non-metal inclusions is melted by use of a high-frequency induction furnace such as CCIM, the non-metal inclusions tend to gather outside the molten metal (on the water-cooled copper crucible side) because the non-metal inclusions are lower in electric conductivity than the metal such as Ti. Therefore, by use of the method of Patent Literature 4, there is a possibility that non-metal inclusions such as $Al_2O_3$ can be localized and physically removed from a Ti—Al alloy.

Further, Patent Literature 5 discloses an induction melting furnace with a water-cooled copper crucible in which a crucible body can move vertically relatively to a stored object that has been stored in the furnace. Patent Literature 5 also suggests that melting of a metal raw material and drawing down of the water-cooled copper crucible are performed repeatedly to produce a long active metal ingot. Patent Literature 5 is similar to Patent Literature 4 at the point that a high-frequency induction furnace with a water-cooled copper crucible is used. In principle, non-metal inclusions tend to gather outside the metal ingot. Therefore, there is a possibility that non-metal inclusions such as $Al_2O_3$ can be physically removed from a Ti—Al alloy in the same manner as in Patent Literature 4.

CITATION LIST

Patent Literature

Patent Literature 1: WO 2016/035824
Patent Literature 2: JP-A-S53-86603
Patent Literature 3: JP-A-2013-49084
Patent Literature 4: JP-A-H11-246919
Patent Literature 5: JP-A-2006-122920

SUMMARY OF INVENTION

Technical Problem

According to the method of Patent Literature 2. $Al_2O_3$ or a CaO—$CaF_2$ flux remaining in a Ti—Al alloy, which causes a problem in Patent Literature 1, can be discharged to the surface of an ingot and removed mechanically therefrom. However, in the method of Patent Literature 2, a flux such as $CaF_2$ is fed in order to smoothen the surface of the ingot. The effect of deoxidization or removal of inclusions cannot be expected.

In addition, when high-oxygen Ti and a CaO—$CaF_2$ flux are continuously fed into a bottomless water-cooled copper mold and drawn out downward while being melted by use of a plasma arc as a heat source as in the continuously casting method of Patent Literature 3, the flux is transferred to between the water-cooled copper mold and the molten metal of a Ti—Al alloy as it is solid or transferred and solidified therebetween immediately after the flux is melted. Thus, the flux is solidified before $Al_2O_3$ is dissolved into the flux to reduce the activity of the $Al_2O_3$ sufficiently. It is therefore considered that the effect of accelerating deoxidization and the effect of removing inclusions due to reduction in activity of $Al_2O_3$ can be hardly expected.

In the method for refining a molten metal according to Patent Literature 4, a metal containing non-metal inclusions is melted simply by use of a cold crucible levitation melting apparatus (CCIM) on conditions which are not suitable for non-metal inclusions such as $Al_2O_3$ to be transferred into a flux. Therefore, even if the non-metal inclusions are transferred into the flux, it is unlikely that an adequate amount of the non-metal inclusions is transferred, but it is likely that the non-metal inclusions may remain in the molten metal (in fact, non-metal inclusions remained in Comparative Examples 1 and 2 to Examples of a second embodiment which will be described later).

In addition, even if the non-metal inclusions such as $Al_2O_3$ are transferred adequately, Patent Literature 4 has no suggestion about how to treat the flux remaining in the molten metal. That is, a Ti—Al alloy having high cleanliness cannot be obtained by use of the technique of Patent Literature 4 as long as the flux remaining in the molten metal cannot be removed by some method.

In addition, the method for producing an active metal ingot according to Patent Literature 5 can collect non-metal inclusions outside the metal ingot in principle in the same manner as in Patent Literature 4. However, the conditions are not suitable for the non-metal inclusions to be transferred into a flux. Practically, therefore, it is likely that non-metal inclusions such as $Al_2O_3$ in a Ti—Al alloy cannot be removed (in Comparative Example 3 according to the second embodiment which will be described later, the result of remaining of non-metal inclusions is actually obtained).

Further, Patent Literature 5 has no assumption about melting with an added flux, and has no suggestion about deoxidization or removal of inclusions. Therefore, when drawing is performed at a drawing rate according to Patent Literature 5, it is unclear whether deoxidization or removal of inclusions can be performed without any problem. For example, the drawing rate is set at 30 mm or less per minute in Patent Literature 5. It is likely that a flux layer may be broken due to such a high drawing rate so that molten metal may be leaked out and deoxidization may not be surely performed.

The present invention has been developed in consideration of the aforementioned problems. An object of the invention is to provide a method for producing a Ti—Al alloy, in which a high-grade and low-oxygen Ti—Al alloy can be produced with high yield and high efficiency from a low-grade titanium material having a high oxygen density.

Solution to Problem

In order to attain the foregoing object, a method for producing a Ti—Al alloy according to the present invention has the following technical configuration.

That is, a method for producing a Ti—Al alloy according to the invention is characterized by including: a primary ingot producing step of melting and holding a melting raw material under an atmosphere of 1.33 Pa or more by a melting method using a water-cooled copper vessel to produce a primary ingot, the melting raw material being prepared by adding a CaO—$CaF_2$ flux to a Ti—Al alloy to contain from 3 to 20 mass % of the CaO—$CaF_2$ flux relative to the Ti—Al alloy, the Ti—Al alloy being composed of a titanium material and an aluminum material and containing 0.1 mass % or more of oxygen and 40 mass % or more of Al, the CaO—$CaF_2$ flux being prepared by mixing calcium fluoride with calcium oxide to contain 35 to 95 mass % of the calcium fluoride; a secondary ingot producing step of melting the primary ingot under an atmosphere of 1.33 Pa or more by a melting method using a bottomless water-cooled copper mold and continuously drawing the primary ingot downward to obtain a secondary ingot; and a flux layer removing step of mechanically removing a flux layer adhering to a surface of the secondary ingot (hereinafter this embodiment may be referred to as first embodiment).

In addition, another method for producing a Ti—Al alloy according to the invention is characterized by including: a raw material dividing step of dividing a melting raw material into n division bodies so that weight of the heaviest one of the division bodies of the divided melting raw material is 4/5 or less of total weight of a final target ingot obtained at an end of casting, the melting raw material being prepared by mixing a CaO—$CaF_2$ flux with a Ti—Al alloy to contain from 3 to 20 mass % of the CaO—$CaF_2$ flux relative to the Ti—Al alloy, the Ti—Al alloy composed of a titanium material and an aluminum material and containing 0.1 mass % or more of oxygen and 40 mass % or more of Al, the $CaO—CaF_2$ flux being prepared by mixing calcium fluoride with calcium oxide to contain 35 to 95 mass % of the calcium fluoride; a division body based ingot producing step of performing an operation of adding a first division body of the melting raw material divided in the raw material dividing step into a bottomless water-cooled copper mold, melting the first division body under an inert gas atmosphere of 1.33 Pa or more and drawing a bottom portion of the water-cooled copper mold downward at a rate of 15 mm or less per minute, then performing an operation of adding a second division body of the melting raw material divided in the raw material dividing step into the water-cooled copper mold, melting the second division body under an inert gas atmosphere of 1.33 Pa or more and drawing the water-cooled copper mold downward at a rate of 15 mm or less per minute, and then repeating the operation for each of following division bodies up to an n-th division body, thereby obtaining an ingot; and a flux layer removing step of mechanically removing a flux layer adhering to a surface of the ingot formed in the division body based ingot producing step (hereinafter this embodiment may be referred to as second embodiment).

It is preferable that a titanium material is added to the ingot after the flux layer removing step, and melted under an atmosphere of 1.33 Pa or more by a melting method using a water-cooled copper vessel (hereinafter also referred to as titanium material adding/melting step), thereby obtaining a Ti—Al alloy having an Al content of less than 40 mass %.

It is preferable that the melting method using the water-cooled copper vessel in the primary ingot producing step is an arc melting method, a plasma arc melting method or an induction melting method.

It is preferable that the melting method using the bottomless water-cooled copper mold in the secondary ingot producing step and the division body based ingot producing step uses a plasma arc or induction heating as a heat source.

Advantageous Effects of Invention

According to a method for producing a Ti—Al alloy according to the present invention, a high-grade and low-oxygen Ti—Al alloy can be produced with high yield and high efficiency from a low-grade titanium material having a high oxygen density.

DESCRIPTION OF EMBODIMENTS

Embodiments of a method for producing a Ti—Al alloy according to the present invention will be described below in detail with reference to the drawings.

Figure 1:
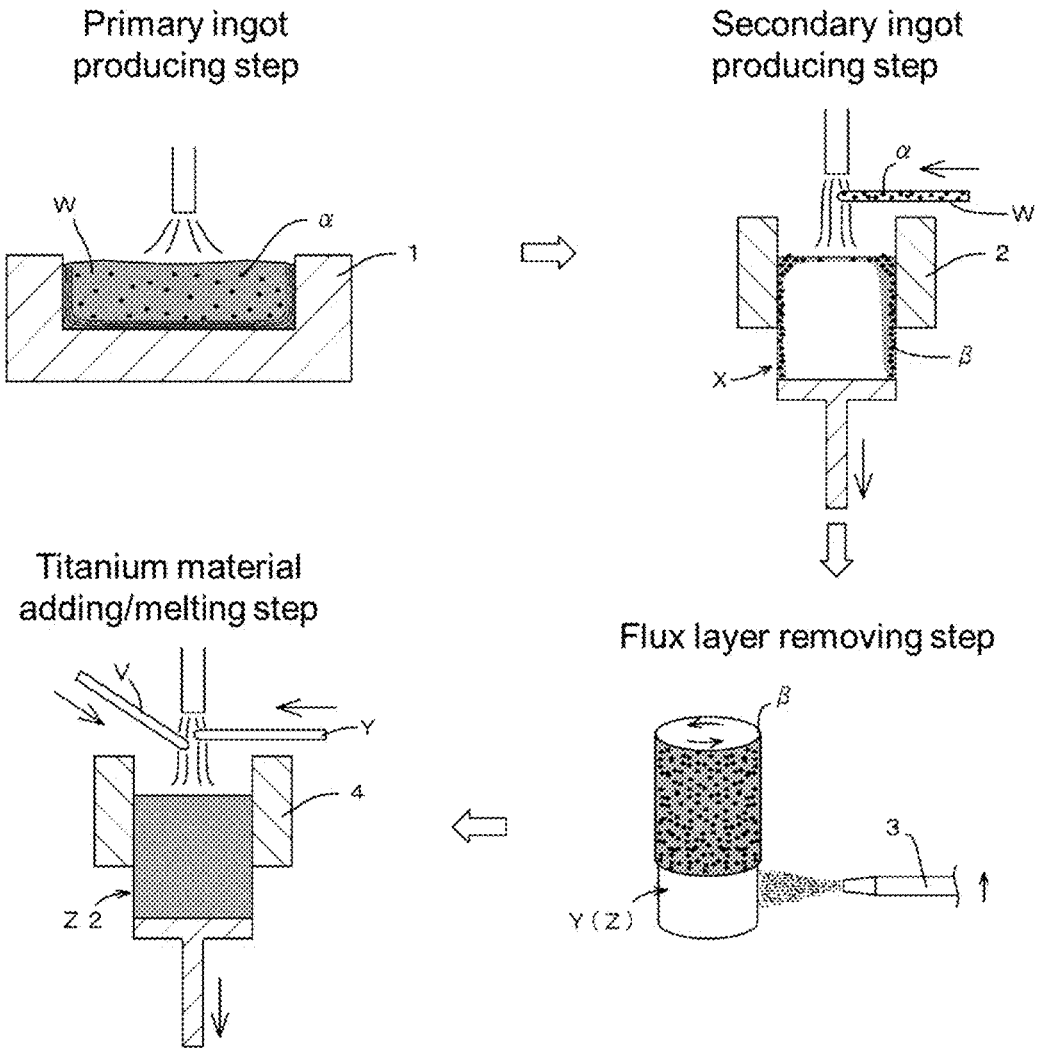
FIG. 1 respectively illustrates steps of a method for producing a Ti—Al alloy according to a first embodiment of the present invention.

First, a first embodiment will be described. As shown in FIG. 1, in a method for producing a Ti—Al alloy according to the embodiment, a high-grade Ti—Al alloy Z having an oxygen content lower than 0.1 mass % is produced from an alloy material W of a Ti—Al alloy containing 0.1 mass % or more of oxygen through three steps from a primary ingot producing step to a flux layer removing step, or preferably through the steps from the primary ingot producing step to the flux layer removing step and further a titanium material adding/melting step performed thereafter.

Specifically, the alloy material W used in the method for producing the Ti—Al alloy Z is a mixture of a titanium material and an aluminum material, and deoxidization is performed due to the effect of aluminum contained in the aluminum material during melting of the alloy material W. In addition, a $CaO—CaF_2$ flux $\alpha$ is further added to the alloy material W in the production method according to the invention, so as to accelerate the deoxidization. According to the production method of the invention configured thus, the high-grade Ti—Al alloy Z having an oxygen content lower than 0.1 mass % can be finally obtained from the alloy material W having an oxygen content of 0.1 mass % or more.

Each of the steps from the primary ingot producing step to the titanium material adding/melting step provided in the production method according to the invention will be described below.

The primary ingot producing step is a step of adding an aluminum material to a titanium material, performing deoxidization on the alloy material W of a Ti—Al alloy and producing the deoxidized alloy material as a primary ingot X.

The aforementioned alloy material W contains 0.1 mass % or more of oxygen (O) in total, and 40 mass % or more of aluminum (Al). That is, the titanium material constituting the alloy material W includes a low-grade titanium material with a high oxygen content, such as sponge titanium, a scrap raw material, or titanium oxide ($TiO_2$) represented by rutile ore. The reason why such a low-grade titanium material is used as the alloy material W is because the titanium material is inexpensive and easily available.

In addition, the aforementioned alloy material W has a total oxygen content of 0.1 mass % or more. When the total content of oxygen in the alloy material W is, for example, lower than 0.1 mass %, the oxygen content is so low that the alloy material W does not have to be deoxidized. Although the upper limit of the oxygen content is not stipulated in the present invention, it is considered that the upper limit of the total content of oxygen contained in the alloy material W as a practical matter is about 25 mass %.

In addition, as the alloy material W to be deoxidized in the primary ingot producing step, a Ti—Al alloy containing 40 mass % or more of Al is used for the following reason.

For example, according to a known Ti—Al—O ternary phase diagram (see FIG. 5 of WO 2016/035824 or the like), the maximum content of solid solution oxygen in a Ti—Al alloy tends to be lower in terms of solid solution oxygen density as the Al content in the Ti—Al alloy Z is increased. That is, the present inventor et al. considered that even when the alloy material W of a Ti—Al alloy is produced using a low-grade titanium material, oxygen in the alloy material can be reduced during deoxidization when the Al content is increased to 40 mass % or more. Thus, the present inventor et al. completed the present invention.

The aforementioned flux $\alpha$ has a function of reducing the activity of $Al_2O_3$ in the alloy material W to thereby accelerate the deoxidization reaction when the flux $\alpha$ is added to the alloy material W. The flux $\alpha$ has an effect of reducing the activity of $Al_2O_3$ as product species in the deoxidization reaction to thereby accelerate the deoxidization reaction when $Al_2O_3$ as a deoxidization product of the Ti—Al alloy is dissolved into the flux $\alpha$.

$Al_2O_3$ is dissolved into the flux α for the first time when the flux α is melted. Therefore, if the melting point of the flux α is too high, the flux α cannot be melted, so that $Al_2O_3$ cannot be dissolved. That is, in the CaO—$CaF_2$ flux α, the melting point of the flux α has to be lowered, for example by increasing the content of $CaF_2$. To this end, in the deoxidization according to the embodiment, the content of $CaF_2$ in the flux α is set to 35 mass % or more to lower the melting point of the flux α to 1,800 K or less. In addition, the content of $CaF_2$ in the flux α is set to 95 mass % or less in order to prevent the Ti—Al alloy Z obtained as a product from being contaminated by fluorine of $CaF_2$.

In addition, the added amount of the aforementioned CaO—$CaF_2$ flux α to the alloy material W is 3 mass % to 20 mass % relative to the Ti—Al alloy Z. When the added amount relative to the Ti—Al alloy Z is lower than 3 mass %, the activity of $Al_2O_3$ is not reduced so much, and the effect of accelerating the deoxidization can be hardly obtained. When the added amount relative to the Ti—Al alloy Z is higher than 20 mass %, the risk that the added flux α may remain in the Ti—Al alloy is increased.

For the deoxidization performed in the primary ingot producing step, the Al content is increased to attain reduction of oxygen. The atmosphere where the deoxidization is performed does not have to be a high vacuum. That is, the deoxidization can be performed satisfactorily even by melting with a water-cooled copper vessel the inside of which is adjusted to an atmosphere of 1.33 Pa or more.

In addition, when the deoxidization is performed under an atmosphere of 1.33 Pa or more, an Al or Ti volatilization loss can be prevented as in deoxidization under a high vacuum atmosphere. That is, a low-oxygen Ti—Al alloy (high-grade Ti—Al alloy) having a target composition can be produced easily in the primary ingot producing step while an Al or Ti volatilization loss is reduced (without substantially lowering the Ti content).

Specifically, in the primary ingot producing step, the primary ingot X is produced while the inside of the water-cooled copper vessel 1 is adjusted to an atmosphere of 1.33 Pa or more, more preferably an atmosphere from 1.33 Pa to $5.33\times10^5$ Pa (≈5 atm).

When the primary ingot X is produced in the primary ingot producing step, it is preferable that the added flux α is stirred sufficiently inside the vessel 1 to thereby accelerate the deoxidization reaction.

For example, as such stirring, stirring with a stirring bar or the like may be used. However, as in the embodiment, an operation in which the ingot solidified inside the vessel 1 (mold) is inverted upside down and remelted may be performed a plurality of times. More preferably, the stirring operation of inverting the ingot (primary ingot F) upside down may be performed two to five times. When the ingot is cast a plurality of times while being inverted upside down, the added flux α can be surely mixed to the alloy material to thereby accelerate the deoxidization reaction. Thus, the primary ingot X which has been deoxidized satisfactorily can be produced.

That is, in the melting method using the water-cooled copper vessel 1 as in the primary ingot producing step, a part of the alloy material close to the vessel wall of the water-cooled copper vessel 1 is not melted due to heat extraction. Therefore, in the first melting, it is likely that there is an unmelted (unreacted) part and a reaction for accelerating deoxidization (reaction between $Al_2O_3$ as a deoxidization product and the CaO—$CaF_2$ flux α) cannot be advanced satisfactorily. Therefore, according to the production method of the embodiment, the operation of inverting the primary ingot X upside down and remelting the inverted primary ingot X is repeated a plurality of times. In this manner, the part which has not been melted in the first melting is melted by the remelting of the inverted primary ingot X after the inversion, so that the reaction with the flux α can be advanced. When the operation is performed a plurality of times, the molten metal inside the vessel 1 (mold) entirely reacts with the flux α. Thus, the primary ingot X satisfactorily deoxidized can be produced even by use of the water-cooled copper vessel 1.

In the primary ingot X subjected to the aforementioned primary ingot producing step, $Al_2O_3$ produced by the deoxidization reaction is contained in the form of the flux α. In the secondary ingot producing step, the flux α is biased and collected in a part (on the outer circumferential side in the embodiment) of the ingot (secondary ingot Y) so that the $Al_2O_3$ produced in the primary ingot producing step can be mechanically removed easily in the flux layer removing step, which will be described later. The ingot where the flux has been biased and collected in this manner is the secondary ingot Y.

Specifically, in the secondary ingot producing step, the primary ingot X is melted by a melting method using a bottomless water-cooled copper mold 2 under an atmosphere of 1.33 Pa or more while being drawn out downward to obtain the secondary ingot Y As the melting method using the water-cooled copper mold 2, a melting method using a plasma arc or induction heating as a heat source may be used. The melting method using a plasma arc as a heat source is preferred. The flux α where $Al_2O_3$ has been dissolved floats in the surface of molten metal supplied into the water-cooled copper mold 2. When a plasma arc is used as a heat source, the flux α is biased and collected in the vicinity of the inner circumferential surface of the mold 2 by an arc sprayed onto the surface of the molten metal. Thus, the molten metal is solidified in the state where the flux α is biased and collected. As a result, in the secondary ingot Y which is produced in the secondary ingot producing step, the flux α is biased and existed on the outer circumferential side of the secondary ingot Y which is drawn out downward. When the flux α is biased and collected on the outer circumferential side in the secondary ingot Y in this manner, a surface-adhering flux layer β formed in the outer circumferential surface of the secondary ingot Y can be scraped off by a mechanical means 3 such as shot blasting or grinding in the flux layer removing step. Thus, the $Al_2O_3$ can be removed together with the flux.

In the flux layer removing step, the surface-adhering flux layer β formed in the outer circumferential surface of the secondary ingot in the secondary ingot producing step is scraped off by the mechanical means 3 such as shot blasting or grinding. When the flux layer removing step is carried out, the oxygen density of the secondary ingot Y can be reduced as a whole.

In the Ti—Al alloy Z obtained through the aforementioned steps from the primary ingot producing step to the flux layer removing step, the surface-adhering flux layer β including the flux α, $Al_2O_3$, etc. biased in the outer circumferential surface of the secondary ingot Y in the secondary ingot producing step has been removed by the mechanical means 3 such as shot blasting or grinding in the flux layer removing step. Therefore, the oxygen content in the Ti—Al alloy Z is largely reduced. Thus, oxygen originally contained in the alloy material W can be surely deoxidized and reduced. That is, by use of the method for producing the Ti—Al alloy Z according to the embodiment, the high-grade, that is, low-oxygen Ti—Al alloy Z can be produced with high yield and high efficiency from low-grade titanium containing oxygen at high concentration.

In the method for producing the Ti—Al alloy Z according to the embodiment, the Al content in the alloy material W is not lower than 40 mass %, so that the total content of oxygen contained in the Ti—Al alloy Z can be lower than 0.1 mass %. Accordingly, the produced Ti—Al alloy Z consequently has an Al content of 40 mass % or more. However, when the Ti—Al alloy Z obtained thus is used, it may be demanded to reduce the Al content to be lower than 40 mass %.

In such a case, a titanium material adding/melting step which will be described below may be carried out in addition to the aforementioned steps from the primary ingot producing step to the flux layer removing step.

That is, in the titanium material adding/melting step, a titanium material V is added to the secondary ingot Y, and melted by a melting method using a water-cooled copper mold 4 (water-cooled copper vessel) under an atmosphere of 1.33 Pa or more, so that a Ti—Al alloy Z2 with an Al content lower than 40 mass % can be obtained. Although the water-cooled copper vessel is used in the illustrated melting method, a melting method which is not a cold crucible induction melting method (CCIM), for example, a vacuum arc remelting method (VAR) or a vacuum induction melting method (VIM) may be used as the melting method for the titanium material adding/melting step.

Specifically, in order to obtain the Ti—Al alloy Z2 with an Al content lower than 40 mass % after the titanium material adding/melting step, the titanium material V to be added to the secondary ingot Y in the titanium material adding/melting step may be set as a titanium material V whose Al content is lower than 40 mass %. For example, when the titanium material V having an Al content lower than 40 mass % such as pure Ti not containing aluminum as impurities, the Al content of the secondary ingot Y is reduced by dilution. Thus, the Ti—Al alloy Z2 whose Al content is lower than 40 mass % can be obtained.

The titanium material V to be added in the titanium material adding/melting step may change depending on the required quality of the Ti—Al alloy Z2 to be produced. It is therefore impossible to stipulate densities of other components than aluminum (other metals than aluminum, such as Sn, V and Mn) in the titanium material V.

However, when the titanium material adding/melting step is carried out in addition to the aforementioned steps from the primary ingot producing step to the flux layer removing step, the Ti—Al alloy Z2 satisfying the required quality as to the other components than oxygen and aluminum can be obtained. Thus, the convenience of the production method according to the present invention can be further enhanced.

Next, a second embodiment will be described.

Figure 2:
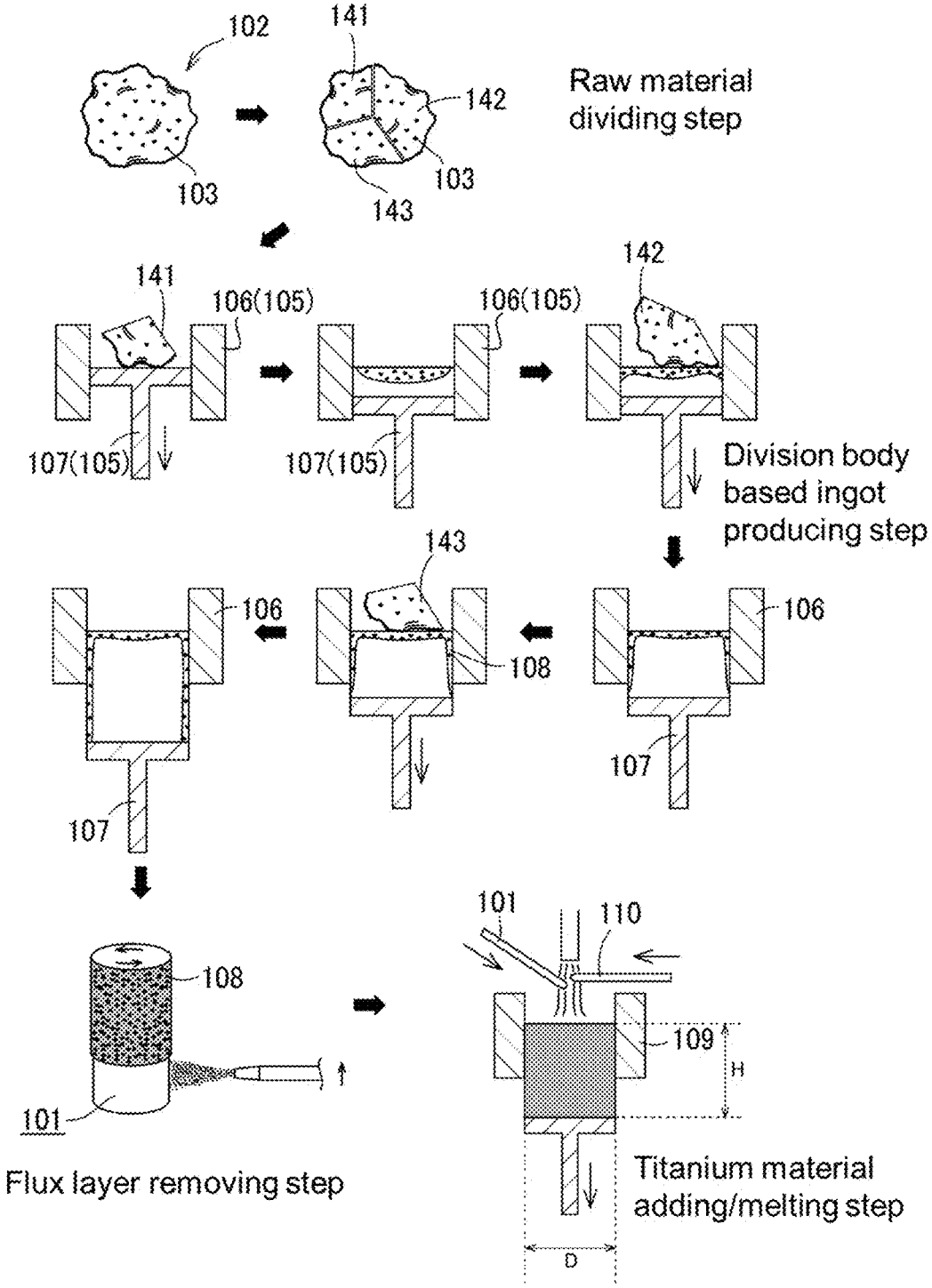
FIG. 2 respectively illustrates steps of a method for producing a Ti—Al alloy according to a second embodiment of the present invention.

As shown in FIG. 2, in the method for producing a Ti—Al alloy 101 according to the embodiment, a high-grade Ti—Al alloy 101 whose oxygen content is lower than 0.1 mass % is produced from an alloy material of the Ti—Al alloy 101 containing an oxygen content of 0.1 mass % or more through three steps from a raw material dividing step to a flux layer removing step, or preferably through the steps from the raw material dividing step to the flux layer removing step and further a titanium material adding/melting step carried out after the steps.

Specifically, the alloy material used in the method for producing the Ti—Al alloy 101 is a mixture of a titanium material and an aluminum material. When a melting raw material 102 blended thus with aluminum is melted in a division body based ingot producing step, the aluminum reacts with oxygen in the alloy material so that deoxidization can be performed. In addition, in the production method according to the embodiment, a CaO—$CaF_2$ flux 103 is added to the alloy material in the raw material dividing step in order to accelerate the deoxidization. When the flux 103 is added thus in the raw material dividing step, the deoxidization is further accelerated in the division body based ingot producing step, so that the high-grade Ti—Al alloy 101 whose oxygen content is lower than 0.1 mass % can be finally obtained from the alloy material whose oxygen content is 0.1 mass % or more.

In addition, the melting raw material 102 added with the flux 103 is divided into a plurality of pieces to form division bodies in the raw material dividing step. Then, in the division body based ingot producing step, an operation of melting a division body of the melting raw material 102 and an operation of drawing the melted division body downward are performed on all the division bodies. Thus, non-metal inclusions such as $Al_2O_3$ can be transferred into the flux 103 while the flux 103 to which the non-metal inclusions have been transferred can be biased (localized) in the outer circumferential surface of the ingot. The non-metal inclusions and the flux 103 biased in this manner are mechanically removed in the flux layer removing step, or preferably components are further adjusted in the titanium material adding/melting step. Thus, the Ti—Al alloy 101 according to the present invention is produced.

Each of the steps from the raw material dividing step to the titanium material adding/melting step provided in the production method according to the invention will be described below.

In the raw material dividing step, the flux 103 is added to the alloy material of the Ti—Al alloy 101 to produce a melting raw material 102, and the produced melting raw material 102 is divided into n pieces to form a first division body 141 to an n-th division body of the melting raw material 102. The production method according to the present invention is characterized by the operation of dividing the melting raw material 102.

Specifically, the alloy material of the Ti—Al alloy 101 used as the melting raw material 102 is a mixture of a titanium material and an aluminum material. The alloy material contains 0.1 mass % or more of oxygen in total, and 40 mass % or more of Al. On the other hand, the flux 103 blended with the alloy material is a CaO—$CaF_2$ flux 103 prepared by blending from 35 to 95 mass % of calcium fluoride with calcium oxide. The flux 103 is blended with the aforementioned alloy material to contain from 3 to 20 mass %. The melting raw material 102 according to the embodiment is prepared thus.

The titanium material constituting the aforementioned alloy material includes a low-grade titanium material with a high oxygen content, such as sponge titanium, a scrap raw material, or titanium oxide ($TiO_2$) represented by rutile ore. The reason why such a low-grade titanium material is used as the alloy material is because the titanium material is inexpensive and easily available.

In addition, the aforementioned alloy material has a total oxygen content of 0.1 mass % or more. When the total content of oxygen in the alloy material is, for example, lower than 0.1 mass %, the oxygen content is so low that the alloy material does not have to be deoxidized. Although the upper limit of the oxygen content is not stipulated in the present invention, it is considered that the upper limit of the total content of oxygen contained in the alloy material as a practical matter is about 25 mass %.

In addition, as the alloy material to be used as the melting raw material 102 in the raw material dividing step, the Ti—Al alloy 101 containing 40 mass/or more of Al is used for the following reason.

For example, according to a known Ti—Al—O ternary phase diagram (see FIG. 5 of WO 2016/035824 or the like), the maximum content of solid solution oxygen in the Ti—Al alloy 101 tends to be lower in terms of solid solution oxygen density as the Al content in the Ti—Al alloy 101 is increased. That is, the present inventor et al. considered that even when the melting raw material containing the Ti—Al alloy 101 produced using a low-grade titanium material is used, oxygen in the alloy material can be reduced during deoxidization in the division body based ingot producing step when the Al content is increased to 40 mass % or more. Thus, the present inventor et al. completed the present invention.

When the aforementioned flux 103 is added to the melting raw material 102, the flux 103 has a function of reducing the activity of $Al_2O_3$ in the melting raw material 102 to thereby accelerate the deoxidization reaction in the division body based ingot producing step, which will be described later. That is, the flux 103 has an effect of reducing the activity of $Al_2O_3$ as product species in the deoxidization reaction to thereby accelerate the deoxidization reaction when $Al_2O_3$ as a deoxidization product of the Ti—Al alloy 101 is dissolved into the flux 103.

$Al_2O_3$ is dissolved into the flux 103 for the first time when the flux 3 is melted. Therefore, if the melting point of the flux 103 is too high, the flux 103 cannot be melted, so that $Al_2O_3$ cannot be dissolved. That is, in the CaO—$CaF_2$ flux 103, for example, the content of $CaF_2$ having a low melting point has to be increased to lower the melting point of the flux 103. Specifically, in the deoxidization according to the embodiment, the content of $CaF_2$ in the flux 103 is set to 35 mass % or more to lower the melting point of the flux 103 to 1,800 K or less. In addition, the content of $CaF_2$ in the flux 103 is set to 95 mass % or less in order to prevent the Ti—Al alloy 101 obtained as a product after the flux layer removing step or the titanium material adding/melting step from being contaminated by fluorine of $CaF_2$.

In addition, the added amount of the CaO—$CaF_2$ flux 103 to the aforementioned melting raw material 102 is 3 mass % to 20 mass % relative to the Ti—Al alloy 101 as a product. When the added amount relative to the Ti—Al alloy 101 is lower than 3 mass %, the activity of $Al_2O_3$ is not reduced so much, and the effect of accelerating the deoxidization can be hardly obtained. When the added amount relative to the Ti—Al alloy 101 is higher than 20 mass %, the risk that the added flux 103 may remain in the produced Ti—Al alloy 101 is increased.

First in the raw material dividing step, the flux 103 is blended with the alloy material to prepare the melting raw material 102 in this manner.

In the aforementioned raw material dividing step, non-metal inclusions such as $Al_2O_3$ cannot be removed satisfactorily only by adding (performing a crucible solidification method) the melting raw material 102 in which the flux 103 has been blended with the alloy material of the Ti—Al alloy 101 into a water-cooled copper crucible 105 and melting. In order to remove the non-metal inclusions satisfactorily, it is necessary to perform the following operation of the division body based ingot producing step.

Specifically, after the aforementioned melting raw material 102 is prepared, the prepared melting raw material 102 is next divided into n pieces to form a first division body 141 to an n-th division body. The division number "n" of the melting raw material 102 is an integer of 2 or more. In the raw material dividing step, the melting raw material 102 is divided into a plurality of division bodies.

In addition, when the melting raw material 102 is divided in the raw material dividing step, the melting raw material 2 is provided so that the weight of the heaviest one of the division bodies (the first division body 141 to the n-th division body) is ⅘ or less of the total weight of a final target ingot which will be obtained at an end of casting. Thus, the melting raw material 2 provided thus is divided into n pieces. For example, as shown in FIG. 2, assume that the weight of a final target ingot is 100 ton. In this case, when the melting raw material 2 is divided into three, it is necessary to divide the melting raw material 2 so that each of the first division body 141 to the third division body 143 does not exceed 80 ton. Industrially, equal division into division bodies (each 33.3 ton in this case) is preferred. However, the present invention is not limited to equal division into division bodies.

When such division is performed, each of the first division body 141 to the n-th division body obtained in the raw material dividing step does not exceed ⅘ of the weight of the final target ingot at the end of casting. Thus, heat extraction from a bottom portion 107 of the water-cooled copper crucible 105 during the casting can be reduced so that the deoxidization reaction can be accelerated satisfactorily.

More in particular, the melting raw material 102 is divided so that the weight of the heaviest one of the division bodies obtained by dividing the melting raw material 102 is ⅘ or less of the total weight of the final ingot, as described above. That is, it is necessary to perform a melting operation at least twice and perform a drawing-down operation at least twice (adding and melting a division body, drawing down the division body, adding/melting a division body, and then drawing down the division body). When the melting operation is performed only once, a part at the bottom portion 107 close to the water-cooled copper crucible 105 is strongly cooled so that solidification is advanced before the charged flux 103 is melted sufficiently. Thus, non-metal inclusions such as $Al_2O_3$ hardly react with the flux 103. In this respect, in the second or following melting operation, heat extraction from the bottom portion 107 is reduced. Therefore, the flux 103 and the non-metal inclusions react sufficiently to accelerate the deoxidization during the second or following melting operation.

When the weight of a division body is set to exceed ⅘ of the total weight of the final target, it is likely that the separation efficiency between the metal and the flux 103 deteriorates in spite of second and following melting operations. For example, assume that the weight of the first division body 141 exceeds ⅘ of the total weight of the final target. In this case, even when the rest amount smaller than ⅕ is melted in the second or following melting, the non-metal inclusions and the flux 103 hardly react with each other. Therefore, the division is performed so that the weight of the heaviest one of the division bodies is preferably ⅘ or less of the total, more preferably ⅔ or less of the total, and further more preferably ½ or less of the total.

The present invention is described in the embodiment illustrated in FIG. 1 along an example in which the melting raw material 102 is divided into three in the raw material dividing step, and each of the three is deoxidized. However, there is no problem even when the number of division bodies is five or eleven.

In the division body based ingot producing step, an operation of adding the first division body 141 of the melting raw material 102 divided in the raw material dividing step into the water-cooled copper crucible 105 (bottomless water-cooled copper crucible 105), melting the first division body 141 under an inert gas atmosphere of 1.33 Pa or more and drawing the water-cooled copper crucible 105 downward at a rate of 15 mm per minute or less is performed. After that, an operation of adding the second division body 142 of the melting raw material 102 divided in the raw material dividing step into the bottomless water-cooled copper crucible 105, melting the second division body 142 under the inert gas atmosphere of 1.33 Pa or more and drawing the water-cooled copper crucible 105 downward at a rate of 15 mm per minute or less is performed. After that, a similar operation is performed up to the n-th division body to form an ingot.

To say other words, in the division body based ingot producing step, a melting operation of adding a division body of the melting raw material 102 into the water-cooled copper crucible 105 and melting the charged division body under the inert gas atmosphere of 1.33 Pa or more is performed once, and an operation of drawing the water-cooled copper crucible 105 downward at the rate of 15 mm per minute or less is performed once. This series of operations is regarded as a "fundamental operation". The fundamental operation is performed once on each of the first division body 141, the second division body 142, . . . , and the n-th division body sequentially.

The reason why melting is performed under an inert gas atmosphere of 1.33 Pa or more is because an Al or Ti volatilization loss as in melting in a high-vacuum atmosphere can be prevented. More preferably, melting is performed under an inert gas atmosphere of 1.33 Pa to $5.33\times10^5$ Pa (≈5 atm).

In the embodiment, the melting raw material 102 is divided into three. Accordingly, the division body based ingot processing step proceeds in such a manner that the melting raw material 102 is processed by a sequence of the melting operation of the first division body 141, the drawing-down operation of the first division body 141, the melting operation of the second division body 142, the drawing-down operation of the second division body 142, the melting operation of the third division body 143, and the drawing-down operation of the third division body 143.

Next, the melting operation and the drawing-down operation performed on each division body of the melting raw material 102 in the division body based ingot processing step will be described in detail.

In the division body based ingot producing step, each division body of the melting raw material 102 is charged into the water-cooled copper crucible 105 (water-cooled copper mold) the inside of which has been adjusted to an inert gas atmosphere of 1.33 Pa or more, and the division body of the melting raw material 102 is melted in the water-cooled copper crucible 105 by use of a plasma arc or induction heating as a heat source, so as to cast an ingot. When the division body of the melting raw material 102 is melted by use of the water-cooled copper crucible 105, it is preferable that the melting is performed using induction heating as a heat source. Typically, when a metal containing non-metal inclusions such as oxides is melted by induction heating, it has been known that the non-metal inclusions are collected outside the molten metal due to a difference in electric conductivity between the non-metal inclusions and the metal. That is, the flux 103 in which $Al_2O_3$ in the molten metal supplied into the water-cooled copper crucible 105 has been dissolved is biased and collected in the vicinity of the inner circumferential surface of the mold due to the induction heating, and solidified in the state where the flux 103 has been biased and collected. As a result, a surface-adhering flux layer 108 in which the flux 103 is biased and located on the outer circumferential side of the ingot drawn out downward is formed in the ingot produced in the division body based ingot producing step. In the ingot where the surface-adhering flux layer 108 is located on the outer circumferential side, the surface-adhering flux layer 108 can be scraped off by a mechanical means such as shot blasting or grinding in the flux layer removing step. Thus, the non-metal inclusions such as $Al_2O_3$ can be removed together with the flux 103.

In addition, in the drawing-down operation following the melting operation of a division body of the melting raw material 102 in the division body based ingot producing step, the surface-adhering flux layer 108 formed in the surface of the ingot by the aforementioned melting operation melting the flux 103 is biased between the mold and the ingot. Specifically, the aforementioned water-cooled copper crucible 105 has a structure in which a cylindrical crucible body 106 with an open top and an open bottom and a bottom portion 107 disposed on the bottom side of the crucible body 106 are combined. The bottom portion 107 of the water-cooled copper crucible 105 is attached movably in the up/down direction relatively to the crucible body 106. When the bottom portion 107 is moved down relatively to the crucible body 106, the ingot mounted on the upper side of the bottom portion 107 can be also moved down. In the division body based ingot producing step, such a drawing-down operation is performed to bias the surface-adhering flux layer 108 on the outer circumferential side of the ingot, that is, between the mold and the ingot.

In addition, in the drawing-down operation according to the embodiment, the drawing-down rate of the ingot, that is, the moving-down speed of the bottom portion 107 of the water-cooled copper crucible 105 is set to 15 mm or less per minute, preferably 10 mm or less per minute. When the drawing-down rate of the ingot exceeds 15 mm per minute, the surface-adhering flux layer 108 formed in the outer circumferential surface of the ingot in the aforementioned division body based ingot producing step is broken so that the surface-adhering flux layer 108 cannot be biased between the mold and the ingot satisfactorily.

Each of the melting operation and the drawing-down operation described above is sequentially performed once on a division body. Such an operation is a "fundamental operation". The "fundamental operation" is performed once on each of the first division body 141, the second division body 142, . . . , and the n-th division body.

For example, in the illustrated case of the division body based ingot producing step, the melting raw material 102 is divided into three, that is, the first division body 141, the second division body 142 and the third division body 143. Accordingly, the melting operation of the first division body 141, the drawing-down operation of the first division body 141, the melting operation of the second division body 142, the drawing-down operation of the second division body 142, the melting operation of the third division body 143, and the drawing-down operation of the third division body 143 are performed so that a cylindrical ingot which is long in the up/down direction can be finally produced (cast) in the division body based ingot producing step.

The surface-adhering flux layer 108 in which the flux 103 has been solidified in a biased state is formed in the outer circumferential surface of the ingot cast in the aforementioned division body based ingot producing step. In the surface-adhering flux layer 108, non-metal inclusions such as $Al_2O_3$ are also contained with high density. Therefore, when the surface-adhering flux layer 108 formed in the outer circumferential surface of the ingot is scraped by a mechanical means such as shot blasting or grinding in the flux layer removing step, the non-metal inclusions such as $Al_2O_3$ can be removed together with the flux 103. Thus, the density of oxygen contained in the ingot can be reduced as a whole.

In the Ti—Al alloy 101 obtained through the aforementioned steps from the raw material dividing step to the flux layer removing step, the surface-adhering flux layer 108 formed in the outer circumferential surface of the ingot in the division body based ingot producing step has been removed by the mechanical means such as shot blasting or grinding in the flux layer removing step. Accordingly, the content of oxygen contained in the Ti—Al alloy 101 has been reduced largely, and oxygen originally contained in the alloy material has been surely deoxidized and reduced. That is, in the method for producing the Ti—Al alloy 101 according to the embodiment, the high-grade, that is, low-oxygen Ti—Al alloy 101 can be produced with high yield and high efficiency from low-grade titanium containing oxygen with high density.

In the method for producing the Ti—Al alloy 101 according to the embodiment, the Al content in the alloy material is made not lower than 40 mass %, so that the total oxygen content in the Ti—Al alloy 101 can be made lower than 0.1 mass %. Accordingly, the produced Ti—Al alloy 101 consequently has an Al content of 40 mass % or more. However, when the Ti—Al alloy 101 obtained thus is used, it may be demanded to reduce the Al content to be lower than 40 mass %.

In such a case, a titanium material adding/melting step which will be described below may be carried out in addition to the aforementioned steps from the raw material dividing step to the flux layer removing step.

That is, in the titanium material adding/melting step, a titanium material is added to the ingot, and melted by a melting method using a water-cooled copper mold (water-cooled copper vessel 109) under an atmosphere of 1.33 Pa or more, so that a Ti—Al alloy 101 with an Al content lower than 40 mass % can be obtained. Although the water-cooled copper vessel is used in the melting method illustrated in FIG. 2, a melting method other than a cold crucible induction melting method (CCIM), for example, a vacuum arc remelting method (VAR) or a vacuum induction melting method (VIM) may be used as the melting method for the titanium material adding/melting step.

Specifically, in order to obtain the Ti—Al alloy 101 with an Al content lower than 40 mass % after the titanium material adding/melting step, the titanium material to be added to the ingot in the titanium material adding/melting step may be a titanium material whose Al content is lower than 40 mass %. For example, when pure Ti not containing aluminum as impurities is added as the titanium material having an Al content lower than 40 mass %, the Al content of the ingot is reduced by dilution. Thus, the Ti—Al alloy 101 whose Al content is lower than 40 mass % can be obtained.

The titanium material to be added in the titanium material adding/melting step may change depending on the required quality of the Ti—Al alloy 101 to be produced. It is therefore impossible to stipulate densities of other components than aluminum (other metals than aluminum, such as Sn, V and Mn) in the titanium material, but it is possible to change the densities of the components desirably.

In addition, in the production method according to the embodiment, a ratio (H/D) of final ingot height H (final target ingot height) to an ingot diameter D is not particularly limited, but the ratio (H/D) is preferably 1 or more in terms of productivity.

When the titanium material adding/melting step is performed in addition to the aforementioned steps from the raw material dividing step to the flux layer removing step, the Ti—Al alloy 101 satisfying the required quality as to the other components than oxygen and aluminum can be obtained. Thus, the convenience of the production method according to the present invention can be further enhanced.

EXAMPLES

Next, the operation and effect of the method for producing a Ti—Al alloy according to the present invention will be described in detail using Comparative Examples and Examples.

(Examples of First Embodiment)

In each of Examples and Comparative Examples, a CaO—$CaF_2$ flux α was added to an alloy material W prepared by blending an aluminum material with a titanium material to thereby remove O (oxygen) contained in the alloy material W.

In Example 1, the steps from the primary ingot producing step to the titanium material adding/melting step were performed on the alloy material W containing 40 mass % of Al and 0.8 mass % of O. In Example 2, the steps from the primary ingot producing step to the titanium material adding/melting step were performed on the alloy material W having an Al content of 50 mass %, which was larger than in Example 1, and containing 0.8 mass % of O.

On the other hand, in each of Comparative Example 1 and Comparative Example 2, of the four steps constituting the production method of the present invention, the secondary ingot producing step and the flux layer removing step were not performed, and the titanium material adding/melting step was performed directly after the primary ingot producing step. In Comparative Example 1, inclusions confirmed to form after the primary ingot producing step were not removed but left as they were. In Comparative Example 2, inclusions were removed as much as possible.

In addition, the primary ingot producing step is a step of producing an intermediate raw material (Ti-40/50 mass % Al-0.8 mass % O) by a plasma arc melting method using scrap Ti, titanium oxide ($TiO_2$), pure Al, and CaO—$CaF_2$ as raw materials. The secondary ingot producing step is a step of remelting the ingot produced in the primary ingot producing step by a plasma arc drawing-out melting method. The flux layer removing step is a step of mechanically removing a flux layer (containing $Al_2O_3$) adhering to the surface of the ingot after the secondary ingot producing step. The titanium material adding/melting step is a step of adding pure Ti (containing 0.05 mass % of O) to the Ti—Al ingot produced in the primary ingot producing step (Comparative Example 1 and Comparative Example 2) or in the primary ingot producing step, the secondary ingot producing step and the flux layer removing step (Example 1 and Example 2), and producing a Ti-30 mass % Al ingot by a plasma arc melting method.

"Comparative Example 1"

An aluminum material of pure Al was blended with a titanium material such as scrap titanium and titanium oxide ($TiO_2$) contained in rutile ore, so as to prepare an alloy material of a Ti—Al alloy in which 40 mass % of Al and 0.8 mass % of O were contained in Ti. Further, a CaO—$CaF_2$ flux was added to the alloy material so that an added amount was 5% relative to the total weight of the Ti—Al alloy. The alloy material to which the flux was added in this manner was cast in a 100 kW plasma arc furnace to produce a primary ingot while performing deoxidization.

The aforementioned CaO—$CaF_2$ flux had a weight ratio of CaO:$CaF_2$=2:8 between CaO and $CaF_2$. In addition, the plasma arc furnace used for producing the primary ingot used Ar as plasma gas. Melting was performed while the plasma gas was supplied into the furnace with a pressure of $1.20\times10^5$ Pa.

In addition, in Comparative Example 1, the titanium material adding/melting step was carried out directly after the primary ingot producing step to thereby produce a Ti—Al alloy. That is, in Comparative Example 1, the secondary ingot producing step of drawing the primary ingot downward continuously while melting the primary ingot by a melting method using a bottomless water-cooled copper mold was not performed. Therefore, $Al_2O_3$ or the flux was involved into the primary ingot and remained thereinside, and the flux layer removing step was not carried out.

The ingot after the primary ingot producing step was cut, and a cut section thereof was observed by SEM to observe an internal structure of the ingot. As a result of the observation of the section by SEM, a part where the flux or oxide inclusions such as $A_2O_3$ were present was confirmed inside the ingot of Comparative Example 1, and a part where the flux or the inclusions such as $Al_2O_3$ were absent was also confirmed thereinside. Oxygen density was measured by an inert gas melting method as to both the part where the inclusions were confirmed and the part where the inclusions were not confirmed. As shown in Table 1, the oxygen density was 1.82 mass % in the position where the inclusions were confirmed, and the oxygen density was 0.24 mass % in the position where the inclusions were not confirmed. From this, it was found that the inclusions confirmed by SEM included the flux or the inclusions such as $Al_2O_3$.

In addition, a titanium material (pure Ti) containing 0.05 mass % of oxygen was further added to the ingot after the primary ingot producing step, and produced to have an Al content of 30 mass %. Thus, a Ti—Al alloy with an oxygen density of 0.79 mass % was obtained. A section of the Ti—Al alloy subjected to the titanium material adding/melting step was observed by SEM. The oxygen inclusions which had been observed after the primary ingot producing step was not confirmed.

For this, it is understood that when pure Ti (a titanium material containing 0.05 mass % of O) is added to an alloy material where oxide inclusions remain after the flux layer removing step as shown in Comparative Example 1, oxides such as $Al_2O_3$ are decomposed and dissolved again in molten metal so as to increase the oxygen density contrarily.

"Comparative Example 2"

In comparison with the aforementioned Comparative Example 1, the Ti—Al alloy region containing the oxide inclusions confirmed after the primary ingot producing step was mechanically removed in Comparative Example 2. That is, oxygen was removed from the Ti—Al alloy due to the removal of the inclusions. Thus, when the Ti—Al alloy was produced to have an Al content of 30 mass %, the oxygen content in Comparative Example 2 was 0.21 mass %, which was lower than the oxygen content in Comparative Example 1. However, when the oxide inclusions were removed, the metal (Ti—Al alloy) was also lost together with the inclusions contained in the ingot. Therefore, an "intermediate raw material use amount" indicating a ratio of a Ti—Al alloy obtained to an alloy material, that is, "yield" was 50%, which was about half the yield in Comparative Example 1.

"Example 1"

In comparison with the aforementioned Comparative Example 1 and Comparative Example 2, the same raw materials as in Comparative Example 1 and Comparative Example 2 were blended to prepare an allow material W, and a CaO—$CaF_2$ flux α (weight ratio of CaO:$CaF_2$=2:8) was further added to the alloy material W to produce a primary ingot X, in Example 1. The primary ingot X was produced on the same treatment conditions as in Comparative Examples. That is, melting was performed using a 100 kW plasma arc furnace with a pressure of $1.20\times10^5$ Pa.

Example 1 is different from Comparative Examples at the point that inversion and remelting, which were not performed in Comparative Examples, were repeated three times.

That is, in the same manner as in Comparative Example 1 and Comparative Example 2, (total) oxygen density was analyzed after the primary ingot producing step by an inert gas melting method as to each of the part where the inclusions were confirmed and the part where the inclusions were not confirmed. The oxygen density was 0.19 mass % in the part where the inclusions were not confirmed, and the oxygen density was 1.90 mass % in the part where the inclusions were confirmed (the part where the inclusions remained). It was estimated that this was because the reaction between $Al_2O_3$ and the CaO—$CaF_2$ flux α was advanced to accelerate the deoxidization reaction due to the inversion and the remelting repeated three times in the primary ingot producing step.

The primary ingot X produced thus in the primary ingot producing step was drawn out downward by a melting method using a plasma arc as a heat source, while a secondary ingot Y was produced.

Figure 3:
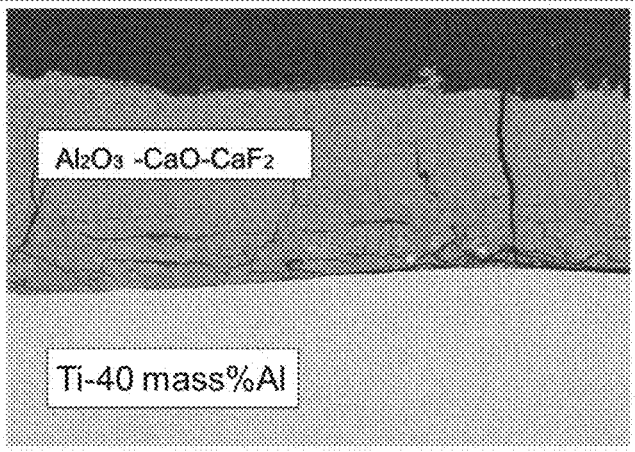
FIG. 3 is an SEM image of a section of a secondary ingot obtained by a production method according to the present invention.

As shown in FIG. 3, the CaO—$CaF_2$ flux α containing $Al_2O_3$ was discharged to the surface of the secondary ingot Y so as to adhere thereto. On the other hand, there was little oxide inclusions inside the secondary ingot Y. It was proved that most of the inclusions which had been located unevenly inside the secondary ingot Y were discharged to the surface of the ingot.

The secondary ingot Y was subjected to shot blasting (mechanical means 3) in the flux layer removing step, so as to remove a flux layer β from the surface of the secondary ingot Y. As the titanium material adding/melting step, pure Ti (oxygen density of 0.05 mass %) was further added to the ingot from which the flux layer β had been removed, so as to produce a Ti-30 mass % Al alloy Z2, and the oxygen density thereof was analyzed.

As a result of the analysis, it was proved that 0.16 mass % of oxygen was contained in the Ti—Al alloy Z2 after the titanium material adding/melting step. There were little oxide inclusions in the internal structure of the alloy. It was therefore proved that increase of oxygen density caused by the remelting of the flux did not occur as in Comparative Example 1. In addition, since only the flux was efficiently removed in the flux layer removing step, the yield was not reduced as in Comparative Example 2. Therefore, it is judged that when deoxidization is performed in the procedure as in Example 1, a high-grade and low-oxygen Ti—Al alloy Z2 whose Al content is lower than 40 mass % can be produced even by use of a low-grade titanium raw material.

"Example 2"

The knowledge obtained as in the aforementioned Example 1 can be also obtained for an alloy material W in Example 2 with an Al content of 50 mass %, which is higher than that in Example 1.

That is, as shown in Table 1, even when the composition of the alloy material W is set as Ti-50 mass % Al-0.8 mass % O, a Ti—Al alloy Z2 whose oxygen density is 0.07 mass % can be produced by producing a Ti-30 mass % Al alloy.

Further, in Comparative Example 3, the steps from the raw material dividing step to the titanium material adding/melting step were performed on an alloy material containing 40 mass % of Al and 0.8 mass % of O in the same manner as in Example 1. Comparative Example 3 was different from Example 1 at the point that the flux 103 was not blended in the melting raw material 102.

TABLE 1

| item | | Comp. Ex. 1 | Comp. Ex. 2 | Example 1 | Example 2 |
|---|---|---|---|---|---|
| primary ingot producing step | smelting composition (mass %) | Ti—40%Al—0.8%O | Ti—40%Al—0.8%O | Ti—40%Al—0.8%O | Ti—50%Al—0.8%O |
| | added amount of CaO—$CaF_2$ (relative to metal weight) | 5 | 5 | 5 | 5 |
| | number of times of melting | 1 | 1 | 3 | 3 |
| | oxygen density (mass %) (position where inclusions were not confirmed) | 0.24 | 0.24 | 0.19 | 0.08 |
| | oxygen density (mass %) (position where inclusions were confirmed) | 1.82 | 1.82 | 1.90 | 1.98 |
| secondary ingot producing step | oxygen density (mass %) (position where inclusions were not confirmed) | | | 0.19 | 0.08 |
| | oxygen density (mass %) (position where inclusions were confirmed) | | | 0.20 | 0.09 |
| flux layer removing step | mechanical removal of flux from ingot surface | | | ○ | ○ |
| titanium material adding/melting step | intermediate raw material (Ti—Al) use amount (yield) | ○ | x | ○ | ○ |
| | oxygen density (mass %) of Ti-30 mass % Al | 0.79 | 0.21 | 0.16 | 0.07 |
| comprehensive evaluation | | x | x | ○ | ○ |

(Examples of Second Embodiment)

In Examples and Comparative Examples, a CaO—$CaF_2$ flux 103 was added to an alloy material prepared by blending an aluminum material with a titanium material and O (oxygen) contained in the alloy material was removed.

In Example 1, the steps from the raw material dividing step to the titanium material adding/melting step were performed on an alloy material containing 40 mass % of Al and 0.8 mass % of O. In Example 2, the steps from the raw material dividing step to the titanium material adding/melting step were performed on an alloy material containing 60 mass % of Al and 0.8 mass % of O. In Example 3, the steps from the raw material dividing step to the titanium material adding/melting step were performed on an alloy material containing 45 mass % of Al and 0.8 mass % of O. In Example 4, the steps from the raw material dividing step to the titanium material adding/melting step were performed on an alloy material containing 52 mass % of Al and 0.8 mass % of O.

The number of divisions of the melting raw material 2 in Examples 1 to 4 was "11", and a "fundamental operation" constituted by a melting operation to be performed once and a drawing-down operation to be performed once was performed on each of the first division body 141 to the eleventh division body (not shown).

On the other hand, in Comparative Example 1, an alloy material having the same composition as in Example 1 was used, but the melting raw material 102 was not divided in the raw material dividing step. Only the melting operation was performed in the division body based ingot producing step to obtain an ingot. In Comparative Example 1, the titanium material adding/melting step was further performed on the obtained ingot to obtain a Ti-30 Al.

Further, in Comparative Example 2, the same treatment as in Comparative Example 1 was performed to obtain an ingot. The titanium material adding/melting step was performed using a specific portion of the obtained ingot.

Specifically, the aforementioned steps from the raw material dividing step to the titanium material adding/melting step were performed on the following conditions.

First, in the raw material dividing step, scrap Ti, titanium oxide ($TiO_2$) and pure Al were used as alloy materials, and a CaO—$CaF_2$ flux 103 was blended by 10% to the weight of the Ti—Al alloy 101 to prepare the melting raw material 102 in Comparative Example 1, Comparative Example 2 and Example 1, while the melting raw material 102 was prepared without blending the flux 103 thereto in Comparative Example 3. The flux 103 used in those Comparative Examples and Examples was a flux 103 (CaO—$CaF_2$ flux 103) containing CaO and $CaF_2$ so as to have a weight ratio of CaO:$CaF_2$=2.8, In addition, in the division body based ingot producing step, the melting raw material 102 prepared in the raw material dividing step was charged into a (bottomless) water-cooled copper crucible 105 (inner diameter of 80 mm) with no bottom, and melted by use of an induction melting apparatus on the condition of a pressure of $6.6\times10^4$ Pa under an Ar atmosphere using argon, which is an inert gas. In the division body based ingot producing step in Examples 1 to 4 and Comparative Example 3, the melting raw material 102 was divided into eleven pieces to form a first division body 141 to an eleventh division body (not shown) in advance, and each of a melting operation and a drawing-down operation was performed once on each of the division bodies to melt and deoxidize the melting raw material 102. On the other hand, in Comparative Example 1 and Comparative Example 2, the division body based ingot producing step itself was not performed, as described above.

As for each ingot cast in the division body based ingot producing step in this manner, the inside of the produced ingot was observed by SEM.

In addition, in the flux layer removing step, the surface of the ingot cast in the division body based ingot producing step was subjected to shot blasting as a mechanical means, so as to remove a surface-adhering flux layer 108 adhering to the surface of the ingot. As for the ingot from which the surface-adhering flux layer 108 had been removed in the flux layer removing step, the density of oxygen contained in the ingot was analyzed by an inert gas melting method.

Further, in the titanium material adding/melting step, pure Ti having an oxygen density of 0.05 mass % was added to the ingot from which the surface-adhering flux layer 108 had been removed in the flux layer removing step, and a Ti-30 mass % Al alloy was produced by use of a plasma arc melting furnace. Also as for the Ti-30 mass % Al alloy produced in the titanium material adding/melting step, the density of oxygen was analyzed by the inert gas melting method in the same manner as the ingot after the flux layer removing step.

Table 2 shows the analysis results of Examples and Comparative Examples.

TABLE 2

| step | item | Comp. Ex. 1 | Comp. Ex. 2 | Comp. Ex. 3 | Example 1 |
|---|---|---|---|---|---|
| melting | blending composition (mass %) | Ti—40%Al—0.8%O | Ti—40%Al—0.8%O | Ti—40%Al—0.8%O | Ti—40%Al—0.8%O |
| | added amount of $CaO—CaF_2$ (mass %) | 10 | 10 | 0 | 10 |
| | producing method | solidification method inside water-cooled copper crucible | | drawing/melting method using bottomless water-cooled copper crucible | |
| | drawing rate (mm/min) | | | 2 | 2 |
| | oxygen density (mass %) (position where inclusions were not confirmed) | 0.50 | 0.51 | 0.75 | 0.30 |
| | oxygen density mass %) (position where inclusions were confirmed) | 1.16 | 1.12 | 0.94 | 0.40 |
| remelting | intermediate raw material (Ti—Al) use amount (yield) | ○ | x | ○ | ○ |
| | oxygen density (mass %) of Ti-30 mass % Al | 0.79 | 0.42 | 0.60 | 0.25 |
| | evaluation | x | x | x | ○ |

| step | item | Example 2 | Example 3 | Example 4 |
|---|---|---|---|---|
| melting | blending composition (mass %) | Ti—60%Al—0.8%O | Ti—45%Al—0.8%O | Ti—52%Al—0.8%O |
| | added amount of $CaO—CaF_2$ (mass %) | 10 | 10 | 10 |
| | producing method | drawing/melting method using bottomless water-cooled copper crucible | | |
| | drawing rate (mm/min) | 2 | | 2 |
| | oxygen density (mass %) (position where inclusions were not confirmed) | 0.045 | 0.16 | 0.042 |
| | oxygen density mass %) (position where inclusions were confirmed) | 0.065 | 0.20 | 0.060 |
| remelting | intermediate raw material (Ti—Al) use amount (yield) | ○ | ○ | ○ |
| | oxygen density (mass %) of Ti-30 mass % Al | 0.057 | 0.15 | 0.055 |
| | evaluation | ○ | ○ | ○ |

"Comparative Example 1"

In Comparative Example 1, the melting raw material 102 was not divided in the raw material dividing step as described above. In the division body based ingot producing step, only the melting operation not accompanied by the drawing-down operation was performed on the melting raw material 102 which had not been divided. Thus, an ingot was obtained.

The ingot obtained in Comparative Example 1 was extracted after the division body based ingot producing step, and observed visually. A surface-adhering flux layer 108 was formed in the surface of the ingot. In Comparative Example 1, the flux 103 involved inside the alloy structure could be also confirmed visually.

In addition, as for the ingot of "Comparative Example 1", the inside of the ingot was also observed by SEM. As a result of the observation by SEM, it was confirmed that a part where $Al_2O_3$ and the flux 103 were absent and a part where the flux 103 was present were mixed inside the ingot.

Further, as for the obtained ingot, oxygen density was analyzed by an inert gas melting method. As a result, 0.50 mass % of oxygen was detected in the part where the inclusions were absent, and 1.16 mass % of oxygen was detected in the part where the inclusions were present.

Further, the aforementioned ingot was melted by use of a plasma arc melting furnace in the titanium material adding/melting step, and pure Ti (oxygen density of 0.05 mass %) was added to the ingot, so as to produce a Ti-30 mass % Al alloy. The oxygen density of the Ti-30 mass % Al alloy obtained thus was analyzed by the inert gas melting method. As a result of the analysis, 0.79 mass % of oxygen was detected. Furthermore, the inside of the ingot of the Ti-30 mass % Al alloy was observed by SEM. As a result, the existence of oxide inclusions such as $Al_2O_3$ was not confirmed.

From the results of the visual observation and SEM observation, it was understood that oxygen in the Ti—Al alloy 101 could not be reduced satisfactorily in Comparative Example 1 because it was determined that the flux 103 and the oxide inclusions (non-metal inclusions) remained in the obtained ingot, and the flux 103 and the oxide inclusions remained even inside the ingot.

In addition, the oxygen density in the Ti—Al alloy 101 in Comparative Examples was measured. The oxygen density much higher than 0.1 mass % was detected independently of the existence of inclusions. From the oxygen density, it was proved that oxygen could not be reduced satisfactorily in the Ti—Al alloy 101.

Further, when the ingot produced once was remelted in the titanium material adding/melting step, the oxygen density increased from 0.50 mass % to 0.79 mass % in the part where the inclusions were absent. It was considered that this was because when pure Ti 110 was added to the ingot in the titanium material adding/melting step, oxide inclusions remaining in the ingot were decomposed by the pure Ti and remelted into Ti—Al to thereby increase the oxygen density.

"Comparative Example 2"

In Comparative Example 2, an ingot was produced using the same melting raw material 102 and the same melting method as in Comparative Example 1. Therefore, the oxygen density was 0.51 mass % in a part of the produced ingot where inclusions were absent and 1.12 mass % in a part of the produced ingot where the inclusions were present. Of the ingot of Comparative Example 2, the part where the inclusions were absent was selected and melted by use of a plasma arc melting furnace, and pure Ti 110 (oxygen density of 0.05 mass %) was added to produce an ingot of a Ti-30 mass % Al alloy. As a result of analysis as to the oxygen density in the produced ingot, the oxygen density was 0.42 mass %, which was lower than in Comparative Example 1.

From this, it is understood that when the titanium material adding/melting step is carried out using the part where little inclusions such as $Al_2O_3$ are confirmed, the oxygen density can be suppressed from increasing due to decomposition of oxide inclusions such as $Al_2O_3$ contained in the ingot, differently from Comparative Example 1. However, the part where the inclusions are present cannot be used as a raw material for remelting. Therefore, as the evaluation about "yield" in Table 1, Comparative Example 1 was evaluated as ○, while Comparative Example 2 was evaluated as x. From this, Comparative Example 2 was comprehensively evaluated as x because the density of oxygen contained in the ingot could be lowered but the yield was poor.

"Comparative Example 3"

In the same manner as in Comparative Example 1 and Comparative Example 2, a melting raw material 102 was prepared to have a composition of Ti-40 mass % Al-0.8 mass % O, and an ingot (2,800 g) was produced. The melting raw material 102 in Comparative Example 3 was different from those in Comparative Example 1 and Comparative Example 2. That is, the melting raw material 102 was produced without blending the flux 103 into the alloy material in the raw material dividing step, and the melting raw material 102 was divided into eleven pieces. Specifically, a first division body 141 first charged into a water-cooled copper crucible 105 had a raw material weight of 800 g (excluding the flux 103), and each of a second division body 142 to an eleventh division body 151 charged additionally after the first division body 141 had a raw material weight of 200 g. The raw material (800 g) of the first division body 141 was charged onto a starting block (a bottom portion 107 of the water-cooled copper crucible 105) made of pure Ti, and melted inside the crucible with a pressure of $6.6\times10^4$ Pa under an Ar atmosphere. After the first division body 141 was melted, a drawing-down operation was carried out to draw down the bottom portion 107 of the crucible at a rate of 2 mm per minute for 5 minutes (10 mm). After that, an additional raw material (200 g) of each of the second and following division bodies charged on an additional adding raw material feeder in advance was charged into the water-cooled copper crucible 105 and melted, and the bottom portion 107 of the crucible was drawn down after the melting. Such an operation was performed on all the division bodies from the second division body 142 to the eleventh division body 151. Thus, an ingot was produced.

The inside of the ingot which had been produced in Comparative Example 3 was observed by SEM. As a result, it was confirmed that apart where little $Al_2O_3$ as non-metal inclusions were present and a part where $Al_2O_3$ as non-metal inclusions were present were mixed in the internal structure, in the same manner as in Comparative Example 1 or Comparative Example 2. In addition, the oxygen density of the ingot was analyzed by the inert gas melting method. As a result, the oxygen density in the part where little metal inclusions were present was 0.75 mass %, and the oxygen density in the part where the metal inclusions were present was 0.94 mass %. From this, it is understood that when melting and deoxidization are performed without using the flux 103, $Al_2O_3$ as non-metal inclusions in Ti—Al is hardly transferred to the surface of the ingot but remains inside the ingot, so that the oxygen density can be hardly reduced even if the melting raw material 102 is divided in the raw material dividing step.

In addition, pure Ti 110 (oxygen density of 0.05 mass %) was added to the aforementioned ingot of Comparative Example 3, and a Ti-30 mass % Al alloy was produced to cast an ingot of the Ti-30 mass % Al alloy by use of a plasma arc melting furnace. The oxygen density of the ingot of the Ti-30 mass % Al alloy was analyzed to be 0.60 mass %. From this, in the same manner as in Comparative Example 1, it is judged that even when the composition of an ingot is adjusted by adding pure Ti to the ingot in which oxide inclusions remain even in the inside of the ingot, the oxide inclusions remaining in the ingot are decomposed by the pure Ti to increase the oxygen density in Ti—Al, so that the oxygen in the Ti—Al alloy 101 cannot be reduced satisfactorily.

"Example 1"

In Example 1, the melting raw material 102 was divided into eleven pieces to produce an ingot in the same manner as in Comparative Example 3. Example 1 was different from Comparative Example 3 at the point that the flux 103 was blended by 10 mass % relative to the weight of the Ti-Al alloy 101.

When the surface of the ingot extracted after the termination of the melting operation was confirmed visually, a layer (surface-adhering flux layer 108) considered to be formed by melting/solidifying of the added flux 103 adhered to the surface of the ingot. When the inside of the same ingot was observed by SEM, it was found that little non-metal inclusions (oxide inclusions) such as $Al_2O_3$ were present inside the ingot. It was estimated that this was because the non-metal inclusions such as $Al_2O_3$ were transferred to the flux layer formed in the surface of the ingot.

In addition, the flux layer (surface-adhering flux layer 108) in the surface of the ingot was able to be removed easily by shot blasting. The oxygen density in the ingot from which the surface-adhering flux layer 108 had been removed by shot blasting was analyzed by the inert gas melting method. As a result, the oxygen density was 0.30 mass % in the part where $Al_2O_3$ was absent. Even in the part where a slight amount of oxide inclusions such as $Al_2O_3$ was confirmed, the oxygen density was very low to be 0.40 mass %. From this, it was proved that the oxygen density in the ingot could be reduced largely in Example 1 in which the flux 103 was blended and the melting raw material 102 was divided in the raw material dividing step, and the melting operation and the drawing-down operation were repeated on each of the division bodies in the division body based ingot producing step.

In addition, the aforementioned ingot of Example 1 was melted by use of a plasma arc melting furnace while pure Ti 110 (oxygen density of 0.05 mass %) was added thereto, so as to produce an ingot of a Ti-30 mass % Al alloy. As a result, the oxygen density of the ingot of the Ti-30 mass % Al alloy was reduced to 0.25 mass %.

From this, it was proved that in the titanium material adding/melting step in Example 1, differently from Comparative Example 1 to Comparative Example 3, there was little oxide inclusion in the ingot, so that the oxygen density hardly increased in spite of remelting, and the yield was not lowered. Therefore, it is judged that by use of the production method according to the present invention, the low-oxygen Ti—Al alloy 101 whose Al content is lower than 40 mass % can be produced with high yield and high efficiency using a low-grade raw material.

"Example 2"

In Example 2, the melting raw material 102 was divided into eleven pieces to produce an ingot in the same manner as in Comparative Example 3. Example 2 was different from Comparative Example 3 at the point that the flux 103 was blended by 10 mass % relative to the weight of the Ti—Al alloy 101.

When the surface of the ingot extracted after the termination of the melting operation was confirmed visually, a layer (surface-adhering flux layer 108) considered to be formed by melting/solidifying of the added flux 103 adhered to the surface of the ingot. When the inside of the same ingot was observed by SEM, it was found that little non-metal inclusions (oxide inclusions) such as $Al_2O_3$ were present inside the ingot. It was estimated that this was because the non-metal inclusions such as $Al_2O_3$ were transferred to the flux layer formed in the surface of the ingot.

In addition, the flux layer (surface-adhering flux layer 108) in the surface of the ingot was able to be removed easily by shot blasting. The oxygen density in the ingot from which the surface-adhering flux layer 108 had been removed by shot blasting was analyzed by the inert gas melting method. As a result, the oxygen density was 0.045 mass % in the part where $Al_2O_3$ was absent. Even in the part where a slight amount of oxide inclusions such as $Al_2O_3$ was confirmed, the oxygen density was very low to be 0.065 mass %. From this, it was proved that the oxygen density in the ingot could be reduced largely in Example 2 in which the flux 103 was blended and the melting raw material 102 was divided in the raw material dividing step, and the melting operation and the drawing-down operation were repeated on each of the division bodies in the division body based ingot producing step.

In addition, the aforementioned ingot of Example 2 was melted by use of a plasma arc melting furnace while pure Ti 110 (oxygen density of 0.05 mass %) was added thereto, so as to produce an ingot of a Ti-30 mass % Al alloy. As a result, the oxygen density of the ingot of the Ti-30 mass % Al alloy was reduced to 0.057 mass %.

From this, it was proved that in the titanium material adding/melting step in Example 2, differently from Comparative Example 1 to Comparative Example 3, there was little oxide inclusion in the ingot, so that the oxygen density hardly increased in spite of remelting, and the yield was not lowered. Therefore, it is judged that by use of the production method according to the present invention, the low-oxygen Ti—Al alloy 101 whose Al content is lower than 60 mass % can be produced with high yield and high efficiency using a low-grade raw material.

"Example 3"

In Example 3, the melting raw material 102 was divided into eleven pieces to produce an ingot in the same manner as in Comparative Example 3. Example 3 was different from Comparative Example 3 at the point that the flux 103 was blended by 10 mass % relative to the weight of the Ti—Al alloy 101.

When the surface of the ingot extracted after the termination of the melting operation was confirmed visually, a layer (surface-adhering flux layer 108) considered to be formed by melting/solidifying of the added flux 103 adhered to the surface of the ingot. When the inside of the same ingot was observed by SEM, it was found that little non-metal inclusions (oxide inclusions) such as $Al_2O_3$ were present inside the ingot. It was estimated that this was because the non-metal inclusions such as $Al_2O_3$ were transferred to the flux layer formed in the surface of the ingot.

In addition, the flux layer (surface-adhering flux layer 108) in the surface of the ingot was able to be removed easily by shot blasting. The oxygen density in the ingot from which the surface-adhering flux layer 108 had been removed by shot blasting was analyzed by the inert gas melting method. As a result, the oxygen density was 0.16 mass % in the part where $Al_2O_3$ was absent. Even in the part where a slight amount of oxide inclusions such as $Al_2O_3$ was confirmed, the oxygen density was very low to be 0.20 mass %. From this, it was proved that the oxygen density in the ingot could be reduced largely in Example 3 in which the flux 103 was blended and the melting raw material 102 was divided in the raw material dividing step, and the melting operation and the drawing-down operation were repeated on each of the division bodies in the division body based ingot producing step.

In addition, the aforementioned ingot of Example 3 was melted by use of a plasma arc melting furnace while pure Ti 110 (oxygen density of 0.05 mass %) was added thereto, so as to produce an ingot of a Ti-30 mass % Al alloy. As a result, the oxygen density of the ingot of the Ti-30 mass % Al alloy was reduced to 0.15 mass %.

From this, it was proved that in the titanium material adding/melting step in Example 3, differently from Comparative Example 1 to Comparative Example 3, there was little oxide inclusion in the ingot, so that the oxygen density hardly increased in spite of remelting, and the yield was not lowered. Therefore, it is judged that by use of the production method according to the present invention, the low-oxygen Ti—Al alloy 101 whose Al content is lower than 45 mass % can be produced with high yield and high efficiency using a low-grade raw material.

"Example 4"

In Example 4, the melting raw material 102 was divided into eleven pieces to produce an ingot in the same manner as in Comparative Example 3. Example 4 was different from Comparative Example 3 at the point that the flux 103 was blended by 10 mass % relative to the weight of the Ti—Al alloy 101.

When the surface of the ingot extracted after the termination of the melting operation was confirmed visually, a layer (surface-adhering flux layer 108) considered to be formed by melting/solidifying of the added flux 103 adhered to the surface of the ingot. When the inside of the same ingot was observed by SEM, it was found that little non-metal inclusions (oxide inclusions) such as $Al_2O_3$ were present inside the ingot. It was estimated that this was because the non-metal inclusions such as $Al_2O_3$ were transferred to the flux layer formed in the surface of the ingot.

In addition, the flux layer (surface-adhering flux layer 108) in the surface of the ingot was able to be removed easily by shot blasting. The oxygen density in the ingot from which the surface-adhering flux layer 108 had been removed by shot blasting was analyzed by the inert gas melting method. As a result, the oxygen density was 0.042 mass % in the part where $Al_2O_3$ was absent. Even in the part where a slight amount of oxide inclusions such as $Al_2O_3$ was confirmed, the oxygen density was very low to be 0.060 mass %. From this, it was proved that the oxygen density in the ingot could be reduced largely in Example 4 in which the flux 103 was blended and the melting raw material 102 was divided in the raw material dividing step, and the melting operation and the drawing-down operation were repeated on each of the division bodies in the division body based ingot producing step.

In addition, the aforementioned ingot of Example 4 was melted by use of a plasma arc melting furnace while pure Ti 110 (oxygen density of 0.05 mass %) was added thereto, so as to produce an ingot of a Ti-30 mass % Al alloy. As a result, the oxygen density of the ingot of the Ti-30 mass % Al alloy was reduced to 0.055 mass %.

From this, it was proved that in the titanium material adding/melting step in Example 4, differently from Comparative Example 1 to Comparative Example 3, there was little oxide inclusion in the ingot, so that the oxygen density hardly increased in spite of remelting, and the yield was not lowered. Therefore, it is judged that by use of the production method according to the present invention, the low-oxygen Ti—Al alloy 101 whose Al content is lower than 52 mass % can be produced with high yield and high efficiency using a low-grade raw material.

The embodiments disclosed herein should be considered not to be restrictive but to be exemplary in all respects. Particularly in the embodiments disclosed herein, values which can be assumed easily by those skilled normally in the art without departing from scopes set normally by them are used as items not disclosed clearly, such as running or operating conditions, various parameters, dimensions, weights or volumes of structures, etc.

The present application is based on Japanese Patent Application No. 2017-032273 filed on Feb. 23, 2017, Japanese Patent Application No. 2017-079928 filed on Apr. 13, 2017, and Japanese Patent Application No, 2017-197905 filed on Oct. 11, 2017, the entire subject matter of which is incorporated herein by reference.

INDUSTRIAL APPLICABILITY

According to the present invention, it is possible to produce a high-grade and low-oxygen Ti—Al alloy with high yield and high efficiency from a low-grade titanium material containing oxygen with high density. The invention is useful particularly in producing a raw material for airplanes or automobiles.

REFERENCE SIGNS LIST

1 water-cooled copper vessel
2 water-cooled copper mold (secondary ingot producing step)
3 mechanical means
4 water-cooled copper mold (titanium material adding/melting step)
V titanium material
W alloy material
X primary ingot
Y secondary ingot
Z Ti—Al alloy (oxygen content lower than 0.1 mass %)
Z2 Ti—Al alloy (oxygen content lower than 0.1 mass %, and Al content lower than 40 mass %)
α a flux
β flux layer
101 Ti—Al alloy
102 melting raw material
103 flux
141 first division body
142 second division body
143 third division body
105 water-cooled copper crucible
106 crucible body
107 bottom portion
108 surface-adhering flux layer
109 water-cooled copper vessel
110 pure Ti

The invention claimed is:

1. A method for producing a Ti—Al alloy, the method comprising:

(a) producing a primary ingot by melting and holding a melting raw material under an atmosphere of 1.33 Pa or more by a melting method using a water-cooled copper vessel to produce a primary ingot, wherein the melting raw material is prepared by adding a CaO—$CaF_2$ flux to a Ti—Al alloy and contains from 3 to 20 mass % of the CaO—$CaF_2$ flux relative to the Ti—Al alloy, the Ti—Al alloy is composed of a titanium material and an aluminum material and comprises 0.1 mass % or more of oxygen and 40 mass % or more of Al, and the CaO—$CaF_2$ flux is prepared by mixing calcium fluoride with calcium oxide and comprises 35 to 95 mass % of the calcium fluoride:

(b) producing a secondary ingot by melting the primary ingot under an atmosphere of 1.33 Pa or more by a melting method using a bottomless water-cooled copper mold and continuously drawing the primary ingot downward to obtain the secondary ingot; and (c) mechanically removing a flux layer adhering to a surface of the secondary ingot.

2. The method according to claim 1, further comprising:

adding a titanium material to the secondary ingot after said removing (c), and melting the secondary ingot under an atmosphere of 1.33 Pa or more by a melting method using a water-cooled copper vessel, thereby obtaining a Ti—Al alloy having an Al content of less than 40 mass %.

3. The method according to claim 1, wherein the melting method in said producing (a) is an arc melting method, a plasma arc melting method or an induction melting method.

4. The method according to claim 1, wherein the melting method in said producing (b) is performed by using a plasma arc or induction heating as a heat source.

* * * * *